US008387272B2

(12) United States Patent
Kim et al.

(10) Patent No.: US 8,387,272 B2
(45) Date of Patent: Mar. 5, 2013

(54) CLOGGING DETECTING SYSTEM FOR DRYER

(75) Inventors: Yang-hwan Kim, Busan (KR); Kyung-hun Kim, Changwon-shi (KR); Ja-in Koo, Changwon-shi (KR); Ju-hyun Kim, Jinhae-shi (KR); Sun-cheol Bae, Masan-shi (KR); Ju-young Min, Changwon-shi (KR); Jin-seok Hu, Masan-shi (KR)

(73) Assignee: LG Electronics Inc., Seoul (KR)

( * ) Notice: Subject to any disclaimer, the term of this patent is extended or adjusted under 35 U.S.C. 154(b) by 1033 days.

(21) Appl. No.: 11/849,531

(22) Filed: Sep. 4, 2007

(65) Prior Publication Data

US 2008/0072450 A1 Mar. 27, 2008

(30) Foreign Application Priority Data

Sep. 6, 2006 (KR) ..... 10-2006-0085857
Sep. 6, 2006 (KR) ..... 10-2006-0085858
Sep. 6, 2006 (KR) ..... 10-2006-0085860
Dec. 26, 2006 (KR) ..... 10-2006-0133893

(51) Int. Cl.
*F26B 13/10* (2006.01)

(52) U.S. Cl. ..... 34/524; 34/572; 34/82; 34/610; 68/20; 68/24; 165/166; 392/465; 73/861.5

(58) Field of Classification Search ..... 34/524, 34/527, 201, 82, 88, 602, 609, 610, 480; 165/166; 392/465; 73/861.5
See application file for complete search history.

(56) References Cited

U.S. PATENT DOCUMENTS

| | | | | |
|---|---|---|---|---|
| 3,363,326 | A | 1/1968 | Weeks | |
| 3,583,688 | A | 6/1971 | Fuqua et al. | |
| 4,206,552 | A | 6/1980 | Pomerantz et al. | |
| 4,231,166 | A | 11/1980 | McMillan | |
| 4,286,391 | A | 9/1981 | Gerry | |
| 4,372,054 | A * | 2/1983 | Pomerantz et al. | 34/526 |
| 4,385,452 | A * | 5/1983 | Deschaaf et al. | 34/562 |
| 4,397,101 | A * | 8/1983 | Rickard | 34/486 |
| 4,422,247 | A * | 12/1983 | Deschaaf | 34/550 |
| 4,485,566 | A | 12/1984 | Vivares | |
| 4,520,576 | A * | 6/1985 | Vander Molen | 34/534 |
| 4,531,305 | A | 7/1985 | Nagayasu et al. | |
| 4,549,362 | A * | 10/1985 | Haried | 34/395 |

(Continued)

FOREIGN PATENT DOCUMENTS

| | | |
|---|---|---|
| CN | 1349013 | 5/2002 |
| CN | 1467013 | 1/2004 |

(Continued)

OTHER PUBLICATIONS

Chinese Office Action dated Apr. 24, 2009.

(Continued)

*Primary Examiner* — Stephen M. Gravini
(74) *Attorney, Agent, or Firm* — KED & Associates LLP

(57) ABSTRACT

The present invention discloses a clogging detecting system for a dryer which can display a clogging degree or state of an air passage to the user through a remote controlling device. The clogging detecting system for the dryer includes the dryer for judging the clogging degree of the air passage, and sending the clogging degree to a remote controlling device, and the remote controlling device for receiving the clogging degree from the dryer, and displaying the clogging degree through a display unit.

17 Claims, 16 Drawing Sheets

U.S. PATENT DOCUMENTS

| | | | | |
|---|---|---|---|---|
| 4,622,759 | A | 11/1986 | Abe et al. | |
| 4,638,374 | A | 1/1987 | Yoshitake et al. | |
| 4,651,748 | A | 3/1987 | Vinogradov et al. | |
| 4,713,894 | A | 12/1987 | Roth et al. | |
| 4,738,034 | A * | 4/1988 | Muramatsu et al. | 34/524 |
| 4,763,425 | A * | 8/1988 | Grennan | 34/552 |
| 4,788,775 | A | 12/1988 | Ahmed | |
| 4,827,627 | A | 5/1989 | Cardoso | |
| 5,050,313 | A | 9/1991 | Wakaeya et al. | |
| 5,097,606 | A * | 3/1992 | Harmelink et al. | 34/467 |
| 5,207,764 | A * | 5/1993 | Akabane et al. | 68/20 |
| 5,291,667 | A * | 3/1994 | Joslin et al. | 34/526 |
| 5,367,787 | A * | 11/1994 | Ikeda et al. | 34/549 |
| 5,444,924 | A * | 8/1995 | Joslin et al. | 34/486 |
| 5,544,428 | A * | 8/1996 | Kuroda et al. | 34/493 |
| 5,649,372 | A * | 7/1997 | Souza | 34/491 |
| 5,887,456 | A * | 3/1999 | Tanigawa et al. | 68/20 |
| 5,940,988 | A * | 8/1999 | Eisen | 34/596 |
| 6,154,978 | A * | 12/2000 | Slutsky | 34/321 |
| 6,158,148 | A * | 12/2000 | Krausch | 34/497 |
| 6,334,267 | B1 * | 1/2002 | Slutsky | 34/606 |
| 6,671,977 | B2 * | 1/2004 | Beaumont | 34/79 |
| 6,725,732 | B1 * | 4/2004 | Stein | 73/861.55 |
| 6,779,279 | B2 * | 8/2004 | Lee et al. | 34/82 |
| 6,785,981 | B1 * | 9/2004 | Harpenau | 34/140 |
| 6,792,694 | B2 | 9/2004 | Lapierre | |
| 6,845,290 | B1 * | 1/2005 | Wunderlin et al. | 700/208 |
| 6,868,621 | B1 * | 3/2005 | Grimm et al. | 34/92 |
| 7,013,578 | B2 * | 3/2006 | Wunderlin et al. | 34/528 |
| 7,040,039 | B1 * | 5/2006 | Stein et al. | 34/529 |
| 7,134,221 | B2 * | 11/2006 | Stein et al. | 34/381 |
| 7,322,126 | B2 * | 1/2008 | Beaulac | 34/554 |
| 7,337,553 | B2 * | 3/2008 | Stein et al. | 34/381 |
| 7,478,486 | B2 * | 1/2009 | Wunderlin et al. | 34/491 |
| 2002/0023368 | A1 * | 2/2002 | Beaumont | 34/79 |
| 2003/0089138 | A1 * | 5/2003 | Kawamura et al. | 68/17 R |
| 2003/0230005 | A1 | 12/2003 | Lapierre | |
| 2004/0006886 | A1 * | 1/2004 | Lee et al. | 34/82 |
| 2004/0159008 | A1 * | 8/2004 | Harpenau | 34/595 |
| 2004/0187343 | A1 * | 9/2004 | Beaumont | 34/544 |
| 2004/0200093 | A1 * | 10/2004 | Wunderlin et al. | 34/606 |
| 2006/0137215 | A1 * | 6/2006 | Stein et al. | 34/529 |
| 2006/0191161 | A1 * | 8/2006 | Wunderlin et al. | 34/562 |
| 2006/0218812 | A1 * | 10/2006 | Brown | 34/86 |
| 2006/0242858 | A1 * | 11/2006 | Beaulac | 34/446 |
| 2006/0272177 | A1 * | 12/2006 | Pezier et al. | 34/528 |
| 2006/0288605 | A1 * | 12/2006 | Carow et al. | 34/446 |
| 2006/0288608 | A1 * | 12/2006 | Carow et al. | 34/604 |
| 2007/0101603 | A1 * | 5/2007 | Beaumont | 34/85 |
| 2007/0107250 | A1 * | 5/2007 | Gassmann et al. | 34/82 |
| 2007/0124954 | A1 * | 6/2007 | Stein et al. | 34/89 |
| 2007/0124955 | A1 * | 6/2007 | Crnkovich | 34/402 |
| 2007/0144031 | A1 * | 6/2007 | Lee | 34/446 |
| 2007/0256322 | A1 * | 11/2007 | Kim et al. | 34/603 |
| 2008/0005924 | A1 * | 1/2008 | Yoo et al. | 34/524 |
| 2008/0034611 | A1 * | 2/2008 | Carow et al. | 34/565 |
| 2008/0052951 | A1 * | 3/2008 | Beaulac | 34/549 |
| 2008/0052954 | A1 * | 3/2008 | Beaulac | 34/572 |
| 2008/0072448 | A1 * | 3/2008 | Hubig et al. | 34/446 |
| 2008/0072450 | A1 * | 3/2008 | Kim et al. | 34/524 |
| 2008/0078100 | A1 * | 4/2008 | Kim et al. | 34/524 |
| 2008/0098615 | A1 * | 5/2008 | Kim | 34/493 |
| 2008/0141557 | A1 * | 6/2008 | Son et al. | 34/565 |
| 2008/0141734 | A1 * | 6/2008 | Son et al. | 68/5 C |
| 2008/0148592 | A1 * | 6/2008 | Kim et al. | 34/89 |
| 2008/0148597 | A1 * | 6/2008 | Kim et al. | 34/549 |
| 2008/0184585 | A1 * | 8/2008 | Yoo et al. | 34/427 |
| 2008/0276484 | A1 * | 11/2008 | Dewald et al. | 34/473 |
| 2008/0282568 | A1 * | 11/2008 | Oh et al. | 34/72 |
| 2008/0307667 | A1 * | 12/2008 | Ikemizu | 34/132 |
| 2008/0313921 | A1 * | 12/2008 | Oh et al. | 34/491 |
| 2008/0313923 | A1 * | 12/2008 | Oh et al. | 34/524 |
| 2009/0064528 | A1 * | 3/2009 | Kim | 34/82 |
| 2009/0100702 | A1 * | 4/2009 | Fair | 34/487 |
| 2009/0139110 | A1 * | 6/2009 | Oh et al. | 34/553 |
| 2009/0145001 | A1 * | 6/2009 | Oh et al. | 34/282 |
| 2009/0172969 | A1 * | 7/2009 | Kim | 34/491 |
| 2009/0211108 | A1 * | 8/2009 | Moschutz et al. | 34/491 |
| 2009/0211111 | A1 * | 8/2009 | Kim et al. | 34/526 |
| 2009/0249639 | A1 * | 10/2009 | Kim et al. | 34/389 |
| 2009/0255142 | A1 * | 10/2009 | Brown | 34/79 |
| 2009/0260256 | A1 * | 10/2009 | Beaulac | 34/528 |
| 2010/0000118 | A1 * | 1/2010 | Cunningham | 34/487 |
| 2010/0024243 | A1 * | 2/2010 | Ricklefs et al. | 34/474 |
| 2010/0050464 | A1 * | 3/2010 | Krzelowski et al. | 34/380 |
| 2010/0058611 | A1 * | 3/2010 | Neumann | 34/487 |

FOREIGN PATENT DOCUMENTS

| | | | | |
|---|---|---|---|---|
| CN | 1766218 | | | 5/2006 |
| DE | 3930727 | A1 | * | 3/1991 |
| DE | 4034273 | A1 | * | 4/1992 |
| DE | 197 04 213 | C1 | | 9/1998 |
| DE | 19728197 | A1 | | 1/1999 |
| DE | 29824834 U 1 | | | 11/2002 |
| DE | 102004021019 | A1 | | 11/2005 |
| EP | 0 106 289 | A2 | | 4/1984 |
| EP | 0 512 940 | A1 | | 5/1992 |
| EP | 0 512 940 | A1 | | 11/1992 |
| JP | 54095466 | A | | 7/1979 |
| JP | 61201557 | A | | 9/1986 |
| JP | 62130339 | A | | 6/1987 |
| JP | 63264272 | A | | 11/1988 |
| JP | 01049370 | A | | 2/1989 |
| JP | 01272992 | A | | 10/1989 |
| JP | 02131146 | A | | 5/1990 |
| JP | 02197756 | | | 8/1990 |
| JP | 03-085199 | | | 4/1991 |
| JP | 03104678 | A | | 5/1991 |
| JP | 03-280999 | | | 12/1991 |
| JP | 04-126199 | | | 4/1992 |
| JP | 04222611 | A | * | 8/1992 |
| JP | 04-325199 | | | 11/1992 |
| JP | 05-161793 | | | 6/1993 |
| JP | 05284828 | A | | 11/1993 |
| JP | 06190196 | A | * | 7/1994 |
| JP | 06281339 | A | * | 10/1994 |
| JP | 07101076 | A | | 4/1995 |
| JP | 07322942 | A | | 12/1995 |
| JP | 08066228 | A | | 3/1996 |
| JP | 08178273 | A | | 7/1996 |
| JP | 08299583 | A | | 11/1996 |
| JP | 09089247 | A | | 4/1997 |
| JP | 09191756 | A | | 7/1997 |
| JP | 09313798 | A | | 12/1997 |
| JP | 10111979 | A | | 4/1998 |
| JP | 10165913 | A | | 6/1998 |
| JP | 10272300 | A | | 10/1998 |
| JP | 10277323 | | | 10/1998 |
| JP | 10334313 | A | | 12/1998 |
| JP | 11-009899 | | | 1/1999 |
| JP | 11009899 | A | * | 1/1999 |
| JP | 11019442 | A | | 1/1999 |
| JP | 11-137897 | | | 5/1999 |
| JP | 2006026075 | A | | 2/2006 |
| JP | 2006055381 | A | * | 3/2006 |
| JP | 2008044686 | A | | 2/2008 |
| JP | 2009284669 | A | | 12/2009 |
| KR | 1998-016229 | | | 5/1998 |
| KR | 10-2003-0020620 | | | 10/2004 |
| WO | WO 2008013258 | A1 | | 1/2008 |

OTHER PUBLICATIONS

Canadian Office Action dated Jun. 3, 2009.
Chinese Office Action dated Oct. 16, 2009.
German Office Action dated May 31, 2010.
German Office Action dated Jun. 2, 2010.
Office Action dated Jul. 21, 2010 for related U.S. Appl. No. 11/850,080.

* cited by examiner

CLOGGING DETECTING SYSTEM FOR DRYER

TECHNICAL FIELD

The present invention relates to a clogging detecting system for a dryer, and more particularly, to a clogging detecting system for a dryer which can display a clogging degree or state of an air passage to the user through a remote controlling device.

BACKGROUND ART

In general, a washing machine with a drying function includes a main body formed in a predetermined shape, a drum installed in the main body, a tub for surrounding the drum and collecting the wash water, a driving motor for rotating the drum, a detergent container for supplying a detergent, a water supply tube connected to the detergent container, for supplying the wash water only or the wash water mixed with the detergent of the detergent container, a drain tube for externally discharging the wash water used in washing, and a pump and a drain hose connected to the end of the drain tube, for forcibly discharging the wash water.

In the washing machine with the drying function, after the laundry and the wash water are put into the drum, the drum is rotated so that the laundry can be dropped in the gravity direction and washed by friction with the wash water. Recently, the drum type washing machine does not only wash the laundry but also dries the laundry by the hot air.

The washing machines with the drying function are classified into a condensation type washing machine and an exhaust type washing machine. In the condensation type washing machine, the hot air generated by a heater is sent to a drum by a ventilation fan, for drying the laundry in the drum. After drying the laundry, the air in the drum becomes the high temperature high humidity air and flows to an exhaust hole communicating with a tub. A nozzle for spraying the cold water is installed at one side of the exhaust hole, for removing moisture from the high temperature high humidity air, and supplying the dry air to the ventilation fan again.

In the exhaust type washing machine, the hot air generated by a heater and a ventilation fan is passed through the laundry in a drum, and externally exhausted from the washing machine through an exhaust hole formed at one side of the washing machine. The exhaust hole is linked to a corrugated hose connected to a tub. In case a baby or a pet is kept shut up in the washing machine, the exhaust hole serves as a vent hole.

When the exhaust type washing machine with the drying function dries the laundry, lint (fine fluff) is generated from the laundry. The lint is circulated with the hot air in the drum of the washing machine, and externally discharged from the washing machine through the exhaust hole.

A structure for periodically collecting the lint generated from the laundry after washing is provided to prevent the lint from being accumulated on the exhaust hole of the washing machine. That is, a lint filter is mounted in the exhaust hole to prevent the lint from clogging up the exhaust hole in long time use of the washing machine.

In the conventional dryer, the exhaust hole passes through an outer wall. The initial state of the exhaust hole (in installation) passing through the outer wall is not checked. Therefore, an installer must arbitrarily judge whether the exhaust hole satisfies the minimum specification for the operation of the dryer.

The conventional dryer recommends filter cleaning in every use. However, the user does not carefully clean the filter due to inconvenience and complication of filter cleaning. The filter is gradually clogged by repeated drying, which increases the drying time or power consumption. When the filter is seriously clogged up, fine lint is not collected in the filter but floats and sticks to the laundry and the dryer and contaminates the laundry. Moreover, in the case of the exhaust type dryer, if the lint clogs the exhaust hole for externally exhausting the used air and interrupts flow of the air, the user cannot easily check clogging of the exhaust hole.

In addition, the conventional dryer can decide or check clogging of the exhaust hole, but cannot provide any information on the current clogging degree of the exhaust hole or the air passage.

DISCLOSURE OF THE INVENTION

The present invention is achieved to solve the above problems. An object of the present invention is to provide a clogging detecting system for a dryer which can precisely judge a clogging degree of an air passage and provide the judgment result to the short or long distance user.

Another object of the present invention is to provide a clogging detecting system for a dryer which can check a clogging degree and a clogged part of an air passage, and provide the checked result through a remote controlling device by a request of the user or independently, and the remote controlling device.

Yet another object of the present invention is to provide a remote controlling device and an interface device thereof which can request confirmation of clogging information of an air passage and display the checked clogging information.

In order to achieve the above-described objects of the invention, there is provided a clogging detecting system for a dryer, including: the dryer for judging a clogging degree of an air passage, and sending the clogging degree to a remote controlling device; and the remote controlling device for receiving the clogging degree from the dryer, and displaying the clogging degree through a display unit. The user can check the clogging degree of the air passage through the remote controlling device installed in a long distance from the dryer.

The remote controlling device sends a request command for the clogging degree of the air passage to the dryer, and the dryer judges and sends the clogging degree of the air passage to the remote controlling device. The user can be provided with the information through communication including the request for the clogging degree and the response to the request.

The remote controlling device includes an input unit for acquiring the request command for the clogging degree of the air passage from the user. The user can be informed of the clogging degree of the air passage in a wanted time.

The dryer includes an input unit for acquiring the request command for the clogging degree of the air passage from the user. If the user is near the dryer, the user can directly input the request command to the dryer and check the clogging degree of the air passage.

The dryer and the remote controlling device perform power line communication or radio frequency communication. Accordingly, the clogging degree of the air passage can be provided to the short or long distance user through the remote controlling device.

The display unit visibly or audibly displays the clogging degree, so that the user can recognize the clogging degree of the air passage according to various methods or instantly.

The display unit displays the clogging degree by at least two steps, so that the user can be informed of the progressive (increase or decrease) degree of the current clogging state of the air passage.

When the clogging degree is over a critical step, the display unit displays a warning message. If the clogging degree of the air passage is increased to cause an accident such as a fire, the user can immediately recognize the clogging state of the air passage.

The display unit displays a clogging degree of a lint filter and a clogging degree of an exhaust duct. The clogging detecting system for the dryer provides not the vague clogging state of the air passage but each clogging degree of the lint filter and the exhaust duct mostly clogged up on the air passage. Therefore, the user can easily check which part needs to be cleaned and repaired.

In another aspect of the present invention, there is provided an interface device for a remote controlling device, including: a communication means for receiving a clogging degree of an air passage from a dryer; and a display means for displaying the clogging degree. The interface device receives the clogging degree of the air passage from the long distance dryer, and provides the clogging degree of the air passage to the user.

The interface device includes a control means for applying a display signal corresponding to the received clogging degree to the display means. Therefore, the user can easily recognize the clogging degree of the air passage. Otherwise, the display signal for display is generated and processed on the display means.

The interface device includes a user input means for requesting the clogging degree of the air passage to the dryer. Accordingly, the user can receive the clogging degree of the air passage from the dryer in a wanted time.

The display means displays the clogging degree by at least two steps.

When the clogging degree is over a critical step, the display means displays a warning message.

The display means displays a clogging degree of a lint filter and a clogging degree of an exhaust duct.

The display means displays a presumed energy consumption amount corresponding to the clogging degree. Since the presumed energy consumption amount corresponding to the current clogging degree is provided to the user, the user can directly feel the current clogging degree by a numerical value.

In yet another aspect of the present invention, there is provided a remote controlling device, including: a communication means for performing communication with a dryer; a control means for controlling the communication means to receive a clogging degree of an air passage from the dryer; and a display means interworking with the control means, for displaying the clogging degree. The remote controlling device receives the clogging degree of the air passage from the long distance dryer, and provides the clogging degree of the air passage to the user.

The control means converts the clogging degree into a display signal, and applies the display signal to the display means.

The control means computes a presumed energy consumption amount corresponding to the clogging degree, and displays the presumed energy consumption amount on the display means.

The remote controlling device includes an input means for acquiring a request command for the clogging degree of the air passage from the user.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A clogging detecting system for a dryer in accordance with the preferred embodiments of the present invention will now be described in detail with reference to the accompanying drawings.

Various claimable aspects of the present invention will now be described. The following description becomes part of the detailed description of the present invention. The following description must be recognized as the technical ideas of the present invention understood in various viewpoints, or the minimum technology for the clogging detecting system for the dryer according to the present invention, not as a limiting boundary of the present invention.

Figure 1:
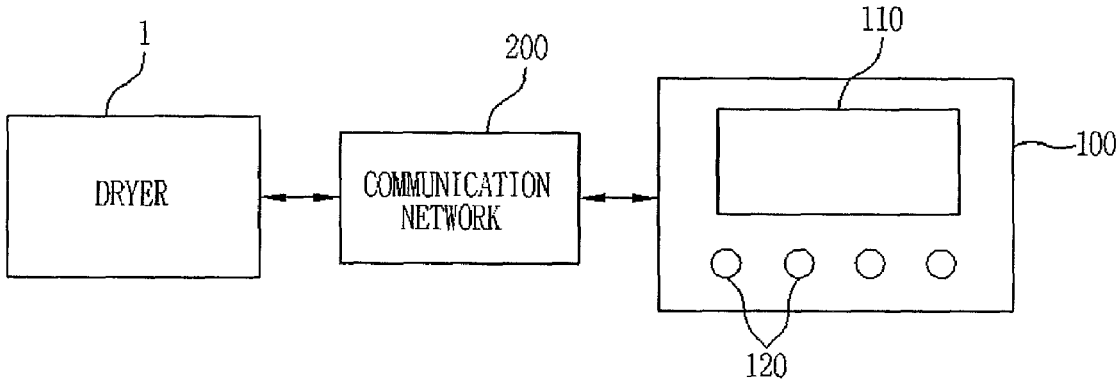
FIG. 1 is a configuration view illustrating a clogging detecting system for a dryer in accordance with the present invention.

FIG. 1 is a configuration view illustrating the clogging detecting system for the dryer in accordance with the present invention. As illustrated in FIG. 1, the clogging detecting system includes the dryer 1 for performing a drying operation and judging a clogging state of an air passage, a remote controlling device 100 for receiving the clogging state of the air passage from the dryer 1, and displaying the clogging state of the air passage, and a communication network 200 for performing data communication between the dryer 1 and the remote controlling device 100.

The dryer 1 basically performs the drying operation and additionally judges the clogging state, clogging degree or clogging progressive degree of the air passage, and a presumed energy consumption amount. The judgment process will later be explained.

The remote controlling device 100 includes an interface device consisting of a display means 110 for displaying the clogging state, clogging degree or clogging progressive (increase or decrease) degree of the air passage, an input means 120 for acquiring a request command for the clogging state of the air passage from the user, and a communication means (not shown) explained later. The remote controlling device 100 will be described below in more detail.

For example, a power line communication medium or a radio frequency communication medium can be used as the communication network 200. The communication network 200 appropriately transmits information between the dryer 1 and the remote controlling device 100 located in a short or long distance.

Figure 2:
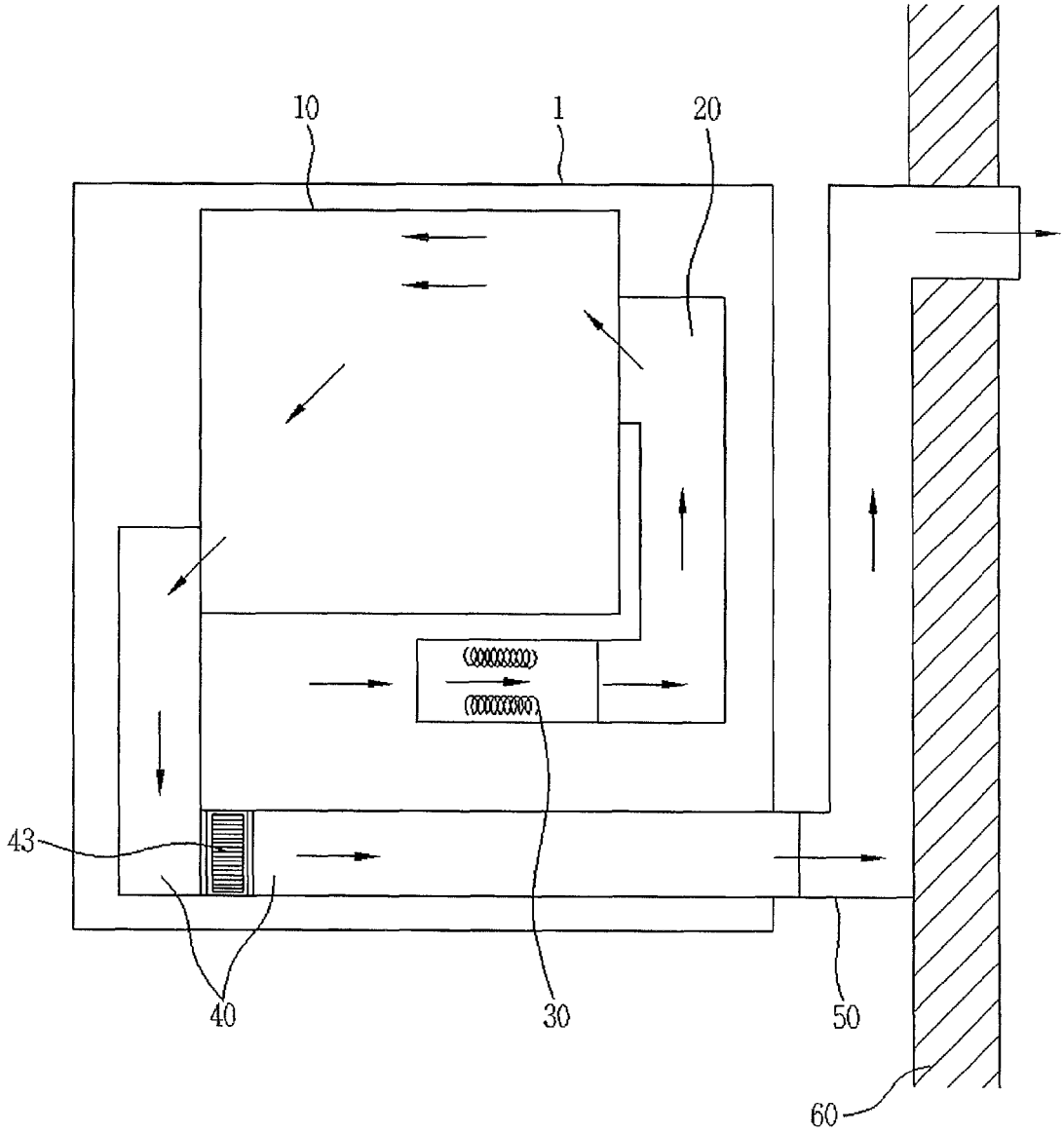
FIG. 2 is a cross-sectional view illustrating the dryer of FIG. 1.
Figure 3:
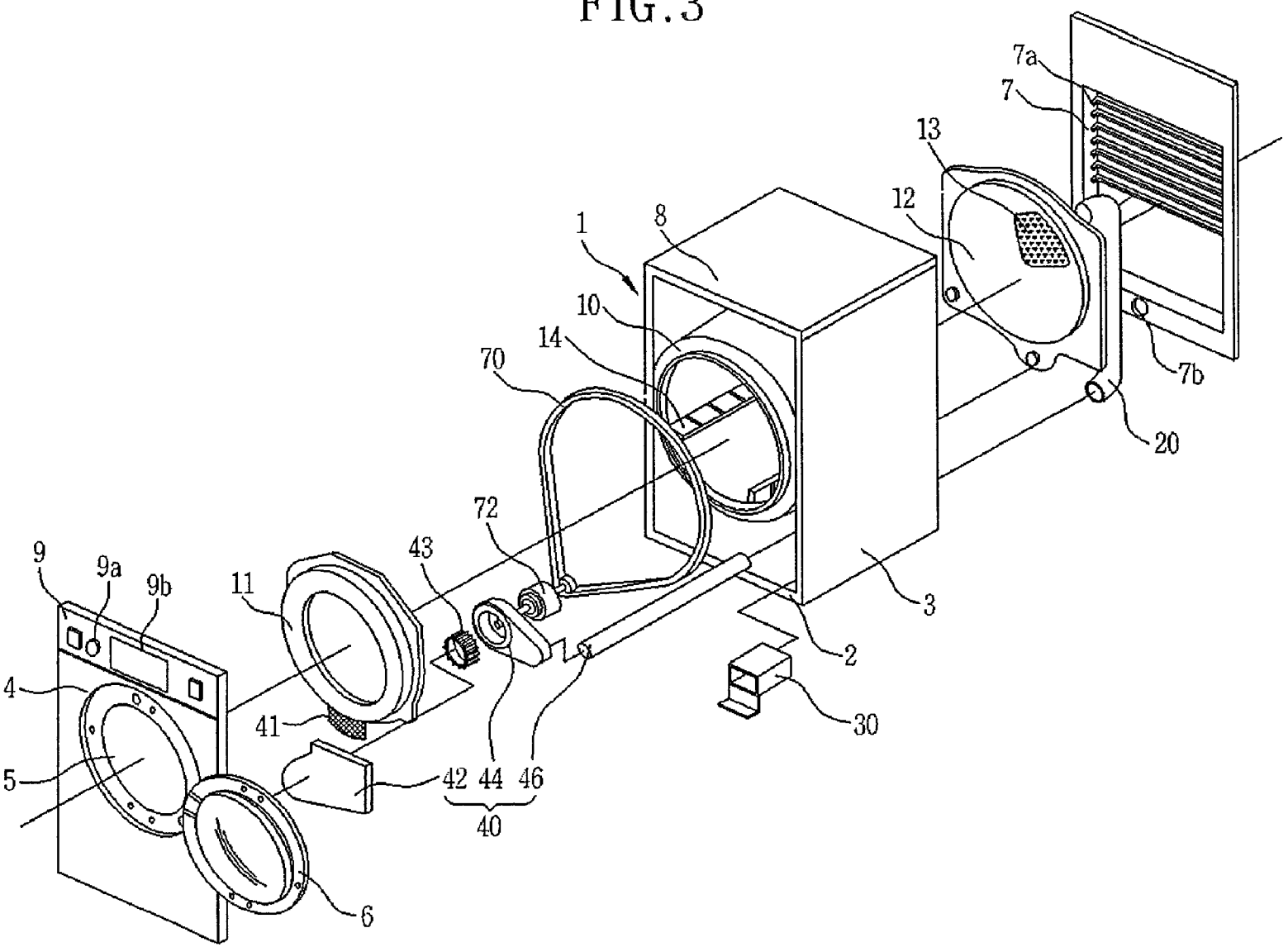
FIG. 3 is an exploded perspective view illustrating the dryer of FIG. 1.
Figure 4:
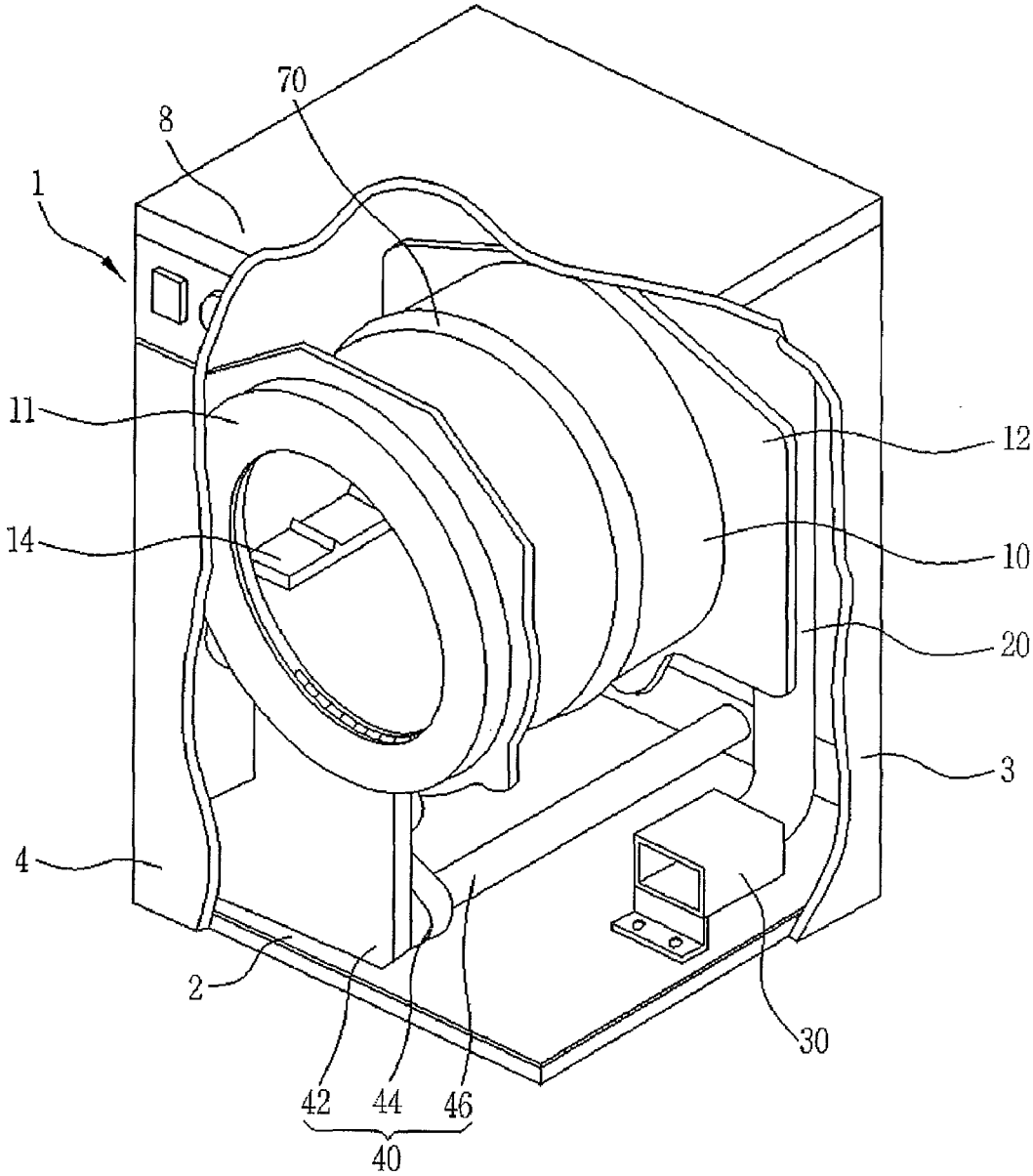
FIG. 4 is a partial cutaway view illustrating the dryer of FIG. 1.

FIG. 2 is a cross-sectional view illustrating the dryer in accordance with the present invention, FIG. 3 is an exploded perspective view illustrating the dryer in accordance with the present invention, and FIG. 4 is a partial cutaway view illustrating the dryer in accordance with the present invention. An exhaust type dryer is exemplified below, which is not intended to be limiting.

Referring to FIG. 2, the exhaust type dryer 1 includes a drum 10 disposed in a cabinet 1, for containing the laundry, a suction passage 20 for supplying the air into the drum 10, a heater 30 installed on the suction passage 20, and an exhaust passage 40 for externally exhausting the air passing through the drum 10 from the cabinet 1. In the case of the exhaust type dryer 1, an exhaust duct 50 is coupled to the exhaust passage 40, for externally exhausting the air through an inner wall 60 of a building.

A ventilation fan 43 is installed at one side of the suction passage 20 or the exhaust passage 40. Hereinafter, it is presumed that the ventilation fan 43 is installed at one side of the exhaust passage 40.

As illustrated in FIGS. 3 and 4, the cabinet 1 includes a base pan 2, a cabinet main body 3 installed at the upper portion of the base pan 2, a cabinet cover 4 installed on the front surface of the cabinet main body 3, a back panel 7 installed on the rear surface of the cabinet main body 3, a top cover 8 installed on the top surface of the cabinet main body 3, and a control panel 9 installed at the top end of the cabinet cover 4.

Still referring to FIG. 3, a laundry inlet 5 for putting the laundry into the drum 10 is formed on the cabinet cover 4, and a door 6 for opening and closing the laundry inlet 5 is rotatably connected to the cabinet cover 4. The control panel 9 is installed at the top end of the cabinet cover 4. The control panel 9 includes an input unit 9*a* for acquiring an input from the user, and a display unit 9*b* for displaying the state of the dryer 1 (for example, the drying processing state, the drying processing degree, the remaining drying time, selection of the drying mode, etc.). A front supporter 11 for rotatably supporting the front end of the drum 10 is mounted at the rear portion of the cabinet cover 4.

A rear supporter 12 for rotatably supporting the rear end of the drum 10 is mounted at the front portion of the back panel 7. A communication hole 13 for making the suction passage 20 and the inlet portion of the drum 10 communicate with each other is formed on the rear supporter 12, so that the air passing through the suction passage 20 can be supplied to the inlet portion of the drum 10.

As shown in FIGS. 3 and 4, the drum 10, which is a cylindrical container for containing the laundry, is opened in the forward and backward directions, so that the air can pass through the drum 10 in the forward and backward directions. The rear opening portion forms the inlet portion of the drum 10, and the front opening portion forms the outlet portion of the drum 10. A lift 14 for lifting and dropping the laundry in rotation of the drum 10 is protruded from the inner circumference of the drum 10.

The suction passage 20 is formed by a suction duct having its bottom end connected to communicate with the rear end of the heater 30 and its top end connected to communicate with the communication hole 13 of the rear supporter 12.

Still referring to FIGS. 3 and 4, the heater 30 installed on the top surface of the base pan 2 includes a heater casing communicating with the suction passage 20, namely, the suction duct 20, and a heat generation coil arranged in the heater casing. When power is supplied to the heat generation coil, the inside space of the heater casing and the heater casing itself are heated so that the air passing through the heater casing can be converted into the high temperature low humidity air.

The exhaust passage 40 is formed by a lint duct 42 communicating with the outlet portion of the drum 10 to exhaust the air from the drum 10, a lint filter 41 for filtering off impurities such as lint from the exhausted air being mounted on the lint duct 42, a fan housing 44 communicating with the lint duct 42 and housing a ventilation fan 43, and an exhaust pipe 46 having its one end connected to communicate with the fan housing 44, and its other end externally elongated from the cabinet 1. The exhaust duct 50 for guiding the air externally exhausted from the cabinet 1 to the outdoor space is connected to the exhaust pipe 46. The exhaust duct 50 is formed outside the cabinet 1, for guiding the air to the outdoor space. The exhaust duct 50 can be installed to pass through the inner wall 60 of the building.

In accordance with the present invention, the air passage includes the suction passage 20, the inside space of the drum 10, the exhaust passage 40 and the exhaust duct 50. Clogging of the air passage mostly occurs in the lint filter 41 of the exhaust passage 40 and the exhaust duct 50. The air flow is relatively less interrupted by clogging of the lint filter 41 of the exhaust passage 40 than clogging of the exhaust duct 50.

The operation of the exhaust type dryer 1 in accordance with the present invention will now be described.

When the user puts the laundry into the drum 10, closes the door 6 and operates the exhaust type dryer 1 by controlling the control panel 9, the exhaust type dryer 1 turns on the heater 30 and drives a motor 72.

When the heater 30 is turned on, the heater 30 heats the inside of the dryer 1, and when the motor 72 is driven, a belt 70 and the ventilation fan 43 are rotated. When the belt 70 is rotated, the drum 10 is rotated. The laundry in the drum 10 is repeatedly lifted and dropped by the lift 14.

When the ventilation fan 43 is rotated, the outdoor air of the cabinet 1 is sucked into an air suction hole 7*a* of the back cover 7 by an air blast force of the ventilation fan 43, and supplied to a gap between the cabinet 1 and the drum 10. The air in the gap between the cabinet 1 and the drum 10 is introduced to the heater 30, heated into the high temperature low humidity air, and sucked into the drum 10 through the suction passage 20 and the communication hole 13 of the rear supporter 12.

The high temperature low humidity air sucked into the drum 10 flows in the forward direction of the drum 10, becomes the high humidity air by contact with the laundry, and is exhausted to the exhaust passage 10.

The air exhausted to the exhaust passage 40 is passed through the exhaust pipe 46, and externally exhausted through the exhaust duct 50.

Figure 5:
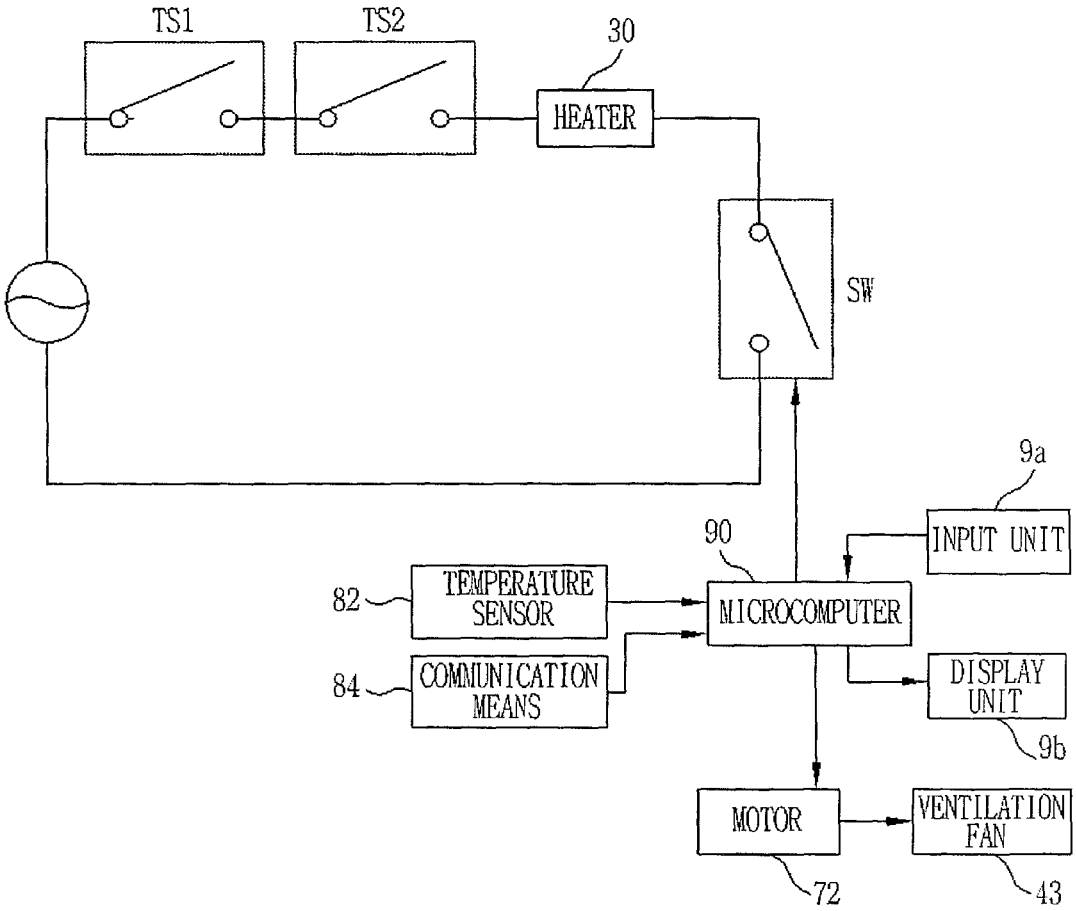
FIG. 5 is a configuration view illustrating a clogging detecting apparatus for the dryer of FIG. 1.

FIG. 5 is a configuration view illustrating a clogging detecting apparatus for the dryer of FIG. 1. As depicted in FIG. 5, the clogging detecting apparatus includes first and second thermostats TS1 and TS2 for supplying external common power to the heater 30, the first and second thermostats TS1 and TS2 being turned on/off according to a temperature of the heater 30 or a temperature of the air heated by the heater 30, a switch SW turned on/off by a control command of a microcomputer 90, for applying the common power to the heater 30, the input unit 9*a*, the display unit 9*b*, the heater 30, the ventilation fan 43, the motor 72, a temperature sensor 82 for sensing an air temperature of the air passage, a communication means 84 for performing communication with the remote controlling device 100, and the microcomputer 90 for turning on/off the switch SW by the temperature sensor 82, and checking the state of the air passage according to the on/off command. A power supply unit for supplying DC power from the common power supply source to the microcomputer 90, the input unit 9*a* and the display unit 9*b* is not shown. However, the power supply unit can be easily understood by the ordinary people in the field to which the present invention pertains.

The first and second thermostats TS1 and TS2, which are a kind of temperature control units, are mounted in the side or proximity of the heater 30, and react to the temperature of the heater 30 or the temperature of the air heated by the heater 30. If the temperature does not reach a predetermined overheat temperature, the first and second thermostats TS1 and TS2 are continuously on. If the temperature exceeds the overheat temperature, the first and second thermostats TS1 and TS2 are turned off not to apply the common power to the heater 30. Especially, to complement the second thermostat TS2, once the first thermostat TS1 is turned off, it does not return to the on state. For example, the first and second thermostats TS1 and TS2 are mounted on the suction passage 20 connected to the heater 30.

The switch SW, which is a kind of relay, maintains the on state during the drying operation by the on control of the microcomputer 90, and maintains the off state by the off control of the microcomputer 90.

The input unit 9*a* receives a control command for drying from the user, and applies the control command to the microcomputer 90.

The display unit 9*b* displays the user input for the drying operation, the drying processing degree, the remaining drying time, and the clogging degree and clogged part of the air passage. In accordance with the present invention, the air passage includes the suction passage 20, the inside of the drum 10, the exhaust passage 40 and the exhaust duct 50. Especially, the air passage can indicate the lint filter 41 of the exhaust passage 40 and the exhaust duct 50.

A thermostat can be used as the temperature sensor 82 for sensing a temperature of the exhaust passage 40. To sense the temperature of the air passing through the lint filter 41, the temperature sensor 82 is mounted at the rear end of the lint filter 41 on the exhaust passage 40. Since the exhaust passage 40 and the exhaust duct 50 communicate with each other, although the temperature sensor 82 is mounted on the exhaust passage 40 behind the lint filter 41, the temperature sensor 82 can sense the most approximate temperature to the temperature of the exhaust duct 50.

The communication means 84 performs communication with the remote controlling device 100 through the communication network 200. That is, the communication means 84 receives the request for the state of the air passage (the clogging state, the clogging degree, the clogging progressive degree, the presumed energy consumption amount, etc.) from the remote controlling device 100, and applies the request to the microcomputer 90. In addition, the communication means 84 receives the state of the air passage from the microcomputer 90, and sends the state of the air passage to the remote controlling device 100. The communication means 84 is a kind of power line communication module or radio frequency communication module.

As described above, the microcomputer 90 performs the drying operation by controlling the heater 30, the switch SW and the motor 72 according to the command of the user from the input unit 9*a*, and operating the ventilation fan 43 by the motor 72. The microcomputer 90 includes a storing unit (not shown) for storing such a control algorithm. For example, an EEPROM can be used as the storing unit.

The microcomputer 90 is mounted on the rear surface of the control panel 9.

In order to maintain the temperature of the exhaust passage 40 within a predetermined range (for example, 100 to 110° C.), the microcomputer 90 controls heat generation of the heater 30 by turning on/off the switch SW according to the temperature sensed by the temperature sensor 82.

The microcomputer 90 uses the following state. For example, if the air passage (especially, the exhaust duct 50 or the lint filter 41) is seriously clogged up, since the air flow from the outdoor space is not smooth, the temperature of the heater 30 or the temperature of the air heated by the heater 30 is raised to influence the first and second thermostats TS1 and TS2 (hereinafter, referred to as 'temperature control unit'). However, the temperature sensed by the temperature sensor 82 is relatively slowly raised because the air flow is not smooth. The microcomputer 90 checks the state of the air passage by using the fact that the on/off control for the switch SW is changed according to the state of the air passage. Here, the state of the air passage includes the clogging degree and the clogged part location of the air passage. For example, if the lint filter 41 is more or less clogged, the clogging degree is weak, and if the exhaust duct 50 is clogged, the clogging degree is serious.

When the clogging degree of the air passage is weak, the air temperature influencing the temperature control unit is rarely different from the temperature sensed by the temperature sensor 82. Even if the temperature is continuously raised, before the temperature control unit intercepts power, the microcomputer 90 controls off of the switch SW.

Conversely, when the clogging degree of the air passage is serious, the air temperature influencing the temperature control unit is much higher than the temperature sensed by the temperature sensor 82. Before the microcomputer 90 controls the switch SW, the temperature control unit is automatically turned off. Accordingly, the microcomputer 90 controls the switch SW after a long time only when the air temperature of the exhaust passage 40 exceeds a predetermined range. However, when the microcomputer 90 checks the state of the air passage after the first use of the dryer 1 or the cleaning of the lint filter 41, the microcomputer 90 checks the state (clogging) of the exhaust duct 50.

The energy consumption amount for performing the drying operation can be experimentally computed in the exhaust duct 50 with a specific diameter in the design of the dryer 1. The correlation between the diameter of the exhaust duct 50 and the energy consumption amount can also be statistically estimated. That is, when the air is not smoothly exhausted by the exhaust duct 50, drying of the laundry in the dryer 1 is delayed, which increases power consumption. Therefore, the microcomputer 90 can estimate or compute the presumed power consumption amount proportional to the clogging degree of the exhaust duct 50. For example, the microcomputer 90 can compute the presumed power consumption amount as not a specific numerical value but a multiple, by comparing the preset diameter or clogging state of the exhaust duct 50 with the checked clogging state of the exhaust duct.

The microcomputer 90 can compute the presumed power consumption amount, and send the state of the air passage containing the presumed power consumption amount to the communication means 84.

The microcomputer 90 has each critical step information on the clogging degree of the exhaust duct 50 and the clogging degree of the lint filter 41. If the clogging degree of the exhaust duct 50 or the clogging degree of the lint filter 41 exceeds the critical step, the microcomputer 90 applies the clogging degree to the display unit 9*b* to perform the corresponding alarm and display, or sends the clogging degree to the remote controlling device 100. For example, the off duty ratio of 0.5 can be set as the critical step of the lint filter 41, and the off duty ratio of 0.8 can be set as the critical step of the exhaust duct 50.

The microcomputer 90 sends the checked state of the air passage to the remote controlling device 100 automatically or by the request of the remote controlling device 100.

Figure 6:
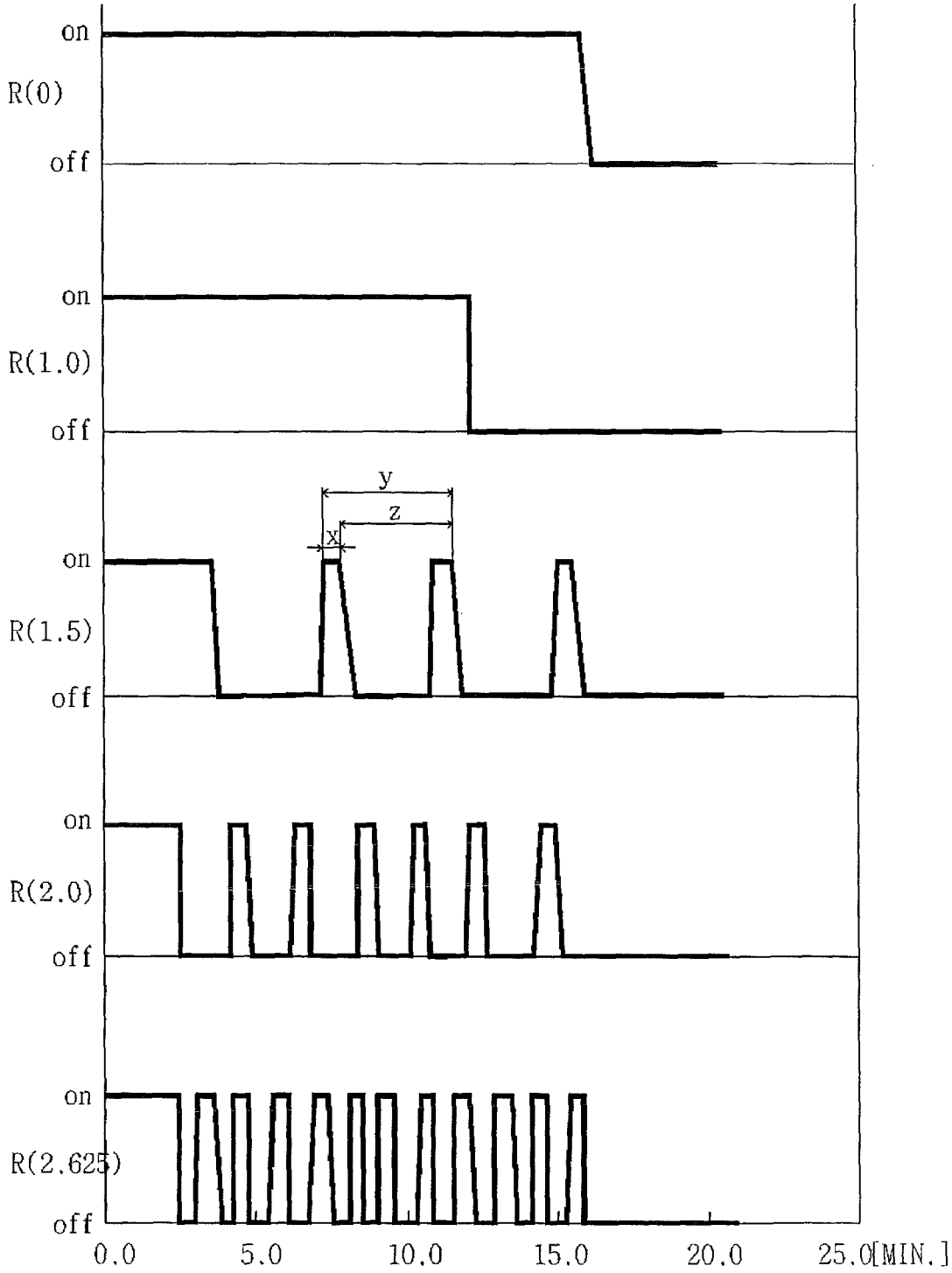
FIG. 6 is a graph showing on/off of a drying operation by temperature recognized by a microcomputer of FIG. 5.

FIG. 6 is a graph showing on/off of the drying operation by temperature recognized by the microcomputer of FIG. 5. In FIG. 6, R represents a diameter of the exhaust duct 50, and the used unit is inch. In the case that the diameter of the exhaust duct 50 is R(0), R(1.0), R(1.5), R(2.0) and R(2.625), the microcomputer 90 turns on/off the switch SW according to the temperature sensed by the temperature sensor 82. If the diameter is large, the state (clogging degree) of the air passage is weak, and if the diameter is small, the state (clogging degree) of the air passage is serious.

A method for computing an on/off duty ratio of power supply is suggested to check the state of the air passage. In this embodiment, one or both of the on duty ratio (x/y) and the off duty ratio (z/y) can be used. Table 1 shows the states of the air passage according to the experiment results including the graph of FIG. 6.

TABLE 1

| Off duty ratio | Clogging degree | Clogged part |
|---|---|---|
| 0~0.30 | — | — |
| 0.30~0.45 | Low (weak) | Lint filter |
| 0.45~0.60 | Middle | Lint filter |
| 0.60~ | High (serious) | Exhaust duct |

The microcomputer 90 stores the lookup table such as Table 1, computes the off duty ratio (or the on duty ratio) reflecting the on/off control characteristic of the switch SW during the drying operation, and compares the lookup table with the prestored lookup table, thereby checking the clogging state (clogging degree, clogged part, etc.) of the corresponding region.

In addition, the microcomputer 90 stores the currently checked state of the air passage, and displays the state of the air passage through the display unit 9*b*. In installation of the dryer 1, the microcomputer 90 notifies successful installation to the user (or installer). That is, when the clogging degree of the air passage is serious, the microcomputer 90 displays a message of requiring re-installation of the dryer 1, or a message of requiring additional wall perforation on the outer wall to widen the exhaust duct 50 to the user (or installer), or sends the state of the air passage to the remote controlling device 100.

The currently checked state of the air passage is influenced by the through hole of the outer wall. The clogging degree of the air passage checked after initial installation of the dryer 1 or cleaning of the lint filter 41 gets more serious due to use of the dryer 1. Therefore, the microcomputer 90 uses the currently checked state of the air passage as a reference state or an offset value.

In the case that the microcomputer 90 uses the currently checked state of the air passage as the reference state (initial clogging degree), the microcomputer 90 checks the state of the air passage in each drying operation automatically or according to the state check command from the user, and compares the state of the air passage with the prestored state of the air passage, thereby deciding the current state of the air passage.

In the case that the microcomputer 90 uses the currently checked state of the air passage as the offset value, the microcomputer 90 performs the drying operation by changing the drying algorithm by reflecting the current state of the air passage. That is, the microcomputer 90 can reflect the state of the air passage to the control temperature of the switch SW, the drying time, etc. of the drying algorithm.

In addition, the microcomputer 90 can display the decided state of the air passage to the user. However, such display is carried out after the user finishes the drying operation by the dryer 1, for preventing the user from stopping the drying operation and cleaning the line filter 41. That is, the user can be protected from a burn.

Figure 7:
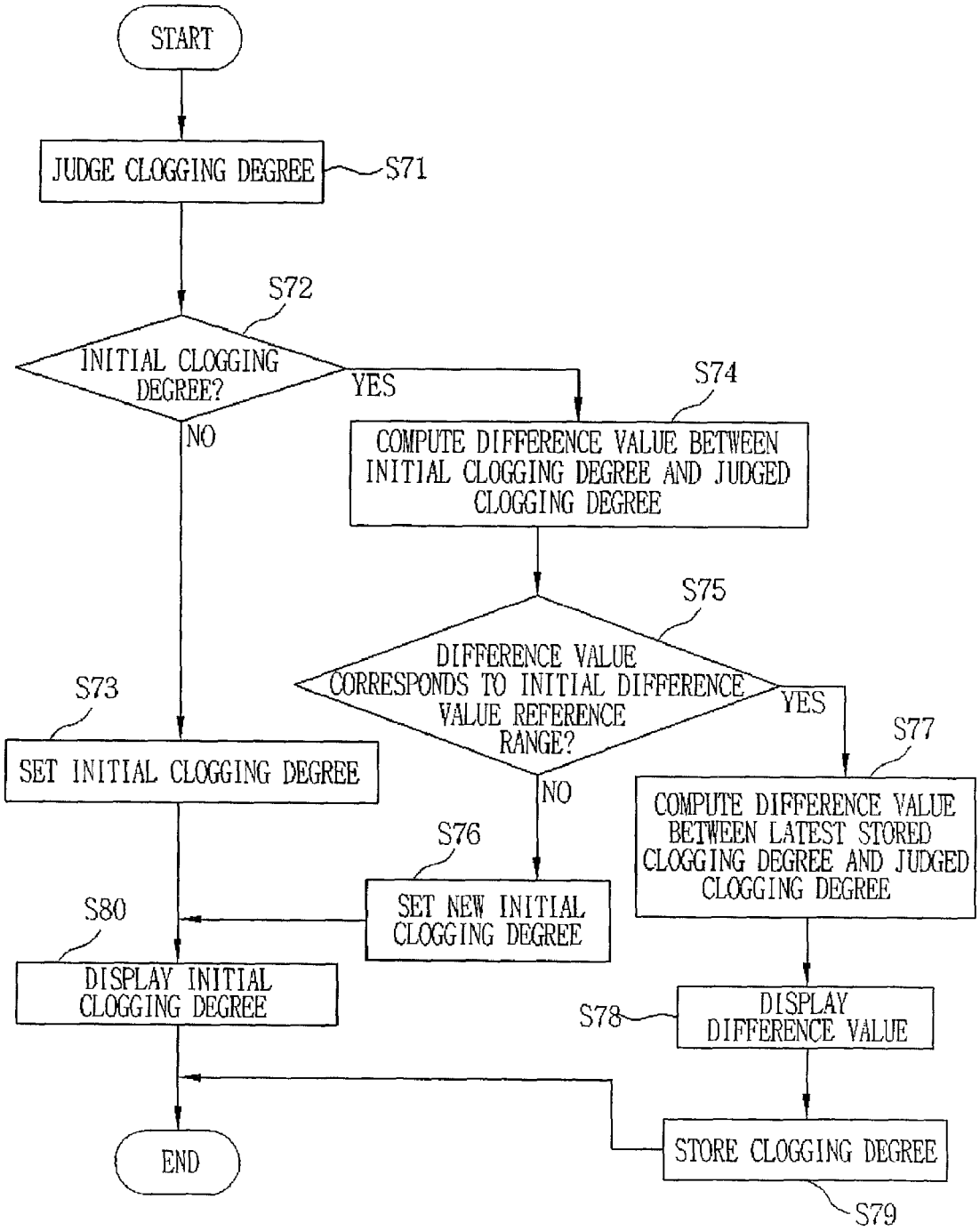
FIG. 7 is a flowchart showing one example of driving of the clogging detecting apparatus for the dryer in accordance with the present invention.

FIG. 7 is a flowchart showing one example of driving of the clogging detecting apparatus for the dryer in accordance with the present invention.

In detail, in step S71, the microcomputer 90 judges the clogging degree of the air passage (including the suction passage 20, the exhaust passage 40 and the exhaust duct 50) of the dryer 1 according to the aforementioned method. Therefore, the microcomputer 90 acquires the on duty ratio (for example, 0.70). The microcomputer 90 can perform the above step S71 according to an individual control algorithm, the clogging degree check command for the air passage inputted by the user through the input unit 9*a*, or the command from the remote controlling device 100. The input unit 9*a* can be installed at the inner portion or on the rear surface of the dryer 1, not the control panel 9, so that the installer of the dryer 1 can directly control and check the input unit 9*a*.

In step S72, the microcomputer 90 decides whether the prestored initial clogging degree exists. If the initial clogging degree exists, the microcomputer 90 goes to step S74, and if not, the microcomputer 90 goes to step S73.

In step S73, the microcomputer 90 sets the judged clogging degree as the initial clogging degree, and stores it in the storing unit. As described above, the initial clogging degree becomes the reference state. If the initial clogging degree is judged when the dryer 1 does not perform the drying operation at all or after the lint filter 41 is cleaned, the initial clogging degree means the clogging degree of the exhaust duct 50.

In step S74, the microcomputer 90 computes a difference value between the prestored initial clogging degree and the currently judged clogging degree. The above step S74 is provided to check progression of the clogging degree of the air passage with the initial clogging degree by the drying operation. In addition, if the dryer 1 is installed in a different space, the initial clogging degree needs to be reset.

In step S75, the microcomputer 90 judges whether the difference value computed in step S74 corresponds to an initial difference value reference. The initial difference value reference is provided to judge re-installation of the dryer 1, or the progressive degree of the clogging state of the exhaust duct 50. As the dryer 1 performs the drying operation, the clogging degree increases. If the judged clogging degree sharply increases (if the state of the exhaust duct 50 is worsened in the current space or due to an error), or sharply decreases (if the state of the exhaust duct 50 is changed due to housing moving or repair), the above step S75 is required to update the initial clogging degree. For example, when the on duty ratio of the initial clogging degree is 0.7 and the judged clogging degree is 0.8, if the initial difference value reference is set as 4% of the initial clogging degree, the initial difference value reference becomes 0.7±0.028. Since the difference value does not correspond to the initial difference value reference, the microcomputer 90 goes to step S76. Conversely, when the judged clogging degree is 0.697, the difference value corresponds to the initial difference value reference, and the microcomputer 90 goes to step S77. The initial difference value reference is the minimum reference that can be influenced by the state of the exhaust duct 50. If the clogging degree of the lint filter 41 reaches the maximum, it influences the clogging degree judged within the initial difference value reference.

In step S76, the microcomputer 90 stores the judged clogging degree as a new initial clogging degree in the storing unit. In this step S76, the microcomputer 90 can additionally judge whether the stored initial clogging degree corresponds to the clogging degree of the exhaust duct 50 of Table 1. The difference value of step S74 represents the additional clogging degree of the exhaust duct 50. If the judged clogging degree is sharply reduced from the initial clogging degree, it means that the clogging increase degree of the exhaust duct 50 is serious. Here, the microcomputer 90 can delete all clogging degrees except the newly stored initial clogging degree.

In step S77, the microcomputer 90 computes a difference value between the latest stored clogging degree and the judged clogging degree. For example, if the latest stored clogging degree is 0.698 and the currently judged clogging degree is 0.697, the difference value becomes 0.01. The difference value represents progression of the clogging degree of the air passage, and corresponds to the clogging degree of the lint filter 41. That is, the clogging degree of the lint filter 41 slowly increases and the clogging degree of the exhaust duct 50 rapidly increases. If the clogging degree of the whole air passage slowly increases, it is caused by clogging of the lint filter 41, and if the clogging degree of the whole air passage rapidly increases, it is caused by clogging of the exhaust duct 50.

In step S78, the microcomputer 90 can display the difference value on the display unit 9*b*, to notify progression of the clogging degree of the lint filter 41.

In step S79, the microcomputer 90 stores the judged clogging degree in the storing unit. If the number of the stored clogging degrees except the initial clogging degree exceeds five, the microcomputer 90 can delete the oldest clogging degree. In addition, the microcomputer 90 stores the difference value as the clogging degree of the lint filter 41.

In step S80, the microcomputer 90 displays the initial clogging degree on the display unit 9*b*. If the routine comes from the steps S73 and S76, the microcomputer 90 can display the initial clogging degree as the clogging degree or the clogged part as shown in Table 1.

The microcomputer 90 checks the clogging degree or clogging progression degree of the exhaust duct 50 by the steps S72 and S73 and the steps S72, S74, S75 and S76, and checks the clogging degree or clogging progression degree of the lint filter 41 by the steps S72, S74, S75 and S77. Accordingly, the microcomputer 90 can simultaneously or alternately display the clogging degrees of the exhaust duct 50 and the lint filter 41 on the display unit 9*b*.

In steps S77 and S78, when the microcomputer 90 has the initial clogging degree and the first judged clogging degree, the difference value between the initial clogging degree and the judged clogging degree represents the clogging degree of the lint filter 41. Thereafter, when the microcomputer 90 acquires the second judged clogging degree, the difference value between the first clogging degree and the second clogging degree corresponds to the additional clogging degree of the lint filter 41. In this manner, the microcomputer 90 checks the clogging progressive degree of the lint filter 41 by each difference value. The sum of the difference values means the current clogging degree of the lint filter 41.

In the above flowchart, the microcomputer 90 can individually check the clogging degree or clogging progressive degree of the exhaust duct 50 and the clogging degree or clogging progressive degree of the lint filter 41.

Figure 8:
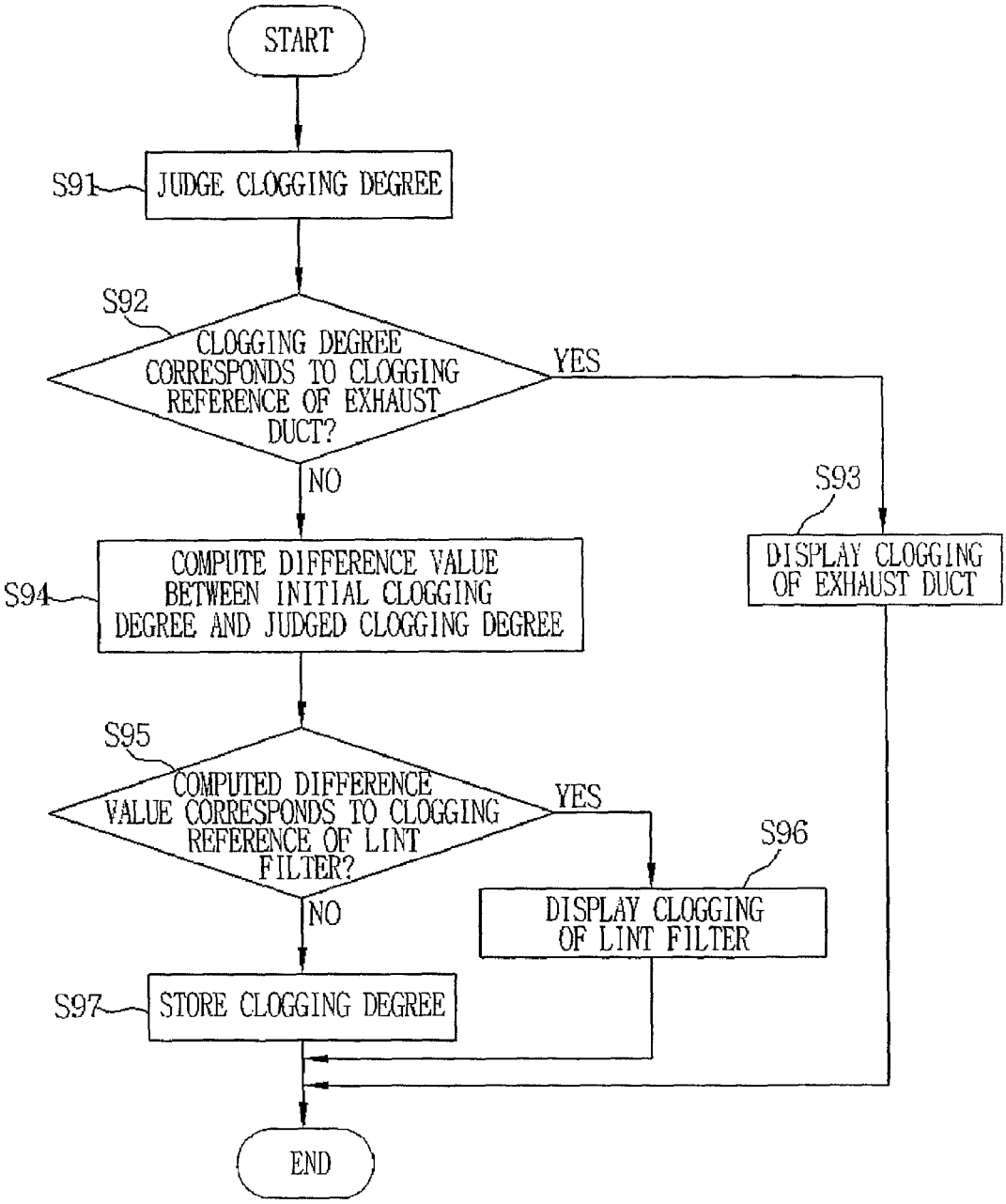
FIG. 8 is a flowchart showing another example of driving of the clogging detecting apparatus for the dryer in accordance with the present invention.

FIG. 8 is a flowchart showing another example of driving of the clogging detecting apparatus for the dryer in accordance with the present invention.

Step S91 is identical to step S71 of FIG. 7

In step S92, the microcomputer 90 decides whether the judged clogging degree corresponds to a clogging reference of the exhaust duct 50. According to the clogging degree reference of the exhaust duct 50 in Table 1, when the on duty ratio is below 0.4, the exhaust duct 50 is deemed to be clogged up. Therefore, if the judged clogging degree corresponds to the clogging degree reference, the microcomputer 90 goes to step S93, and if not, the microcomputer 90 goes to step S94.

In step S93, the microcomputer 90 decides that the exhaust duct 50 has been clogged, and displays clogging of the exhaust duct 50 on the display unit 9*b*.

In step S94, the microcomputer 90 computes a difference value between the initial clogging degree and the judged clogging degree. For example, if the on duty ratio of the initial clogging degree is 0.7 and the judged clogging degree is 0.67, the difference value becomes 0.03. If the judged clogging degree is 0.61, the difference value becomes 0.09.

In step S95, the microcomputer 90 judges whether the computed difference value corresponds to a clogging reference of the lint filter 41. For example, if the clogging reference of the lint filter 41 is a difference value over 0.07, the difference value 0.03 computed in step S94 does not correspond to the clogging reference, and thus the microcomputer 90 goes to step S97. Meanwhile, the difference value 0.09 computed in step S94 corresponds to the clogging reference, and thus the microcomputer 90 goes to step S96.

In step S96, the microcomputer 90 decides that the lint filter 41 has been clogged up, and displays clogging of the lint filter 41 on the display unit 9*b*.

In step S97, the microcomputer 90 stores the judged clogging degree in the storing unit. Here, the microcomputer 90 can display the normal state of the air passage on the display unit 9*b*.

In FIG. 8, the microcomputer 90 can notify clogging of the exhaust duct 50, clogging of the lint filter 41, or the normal state of the air passage to the user according to the judged clogging degree.

Figure 9:
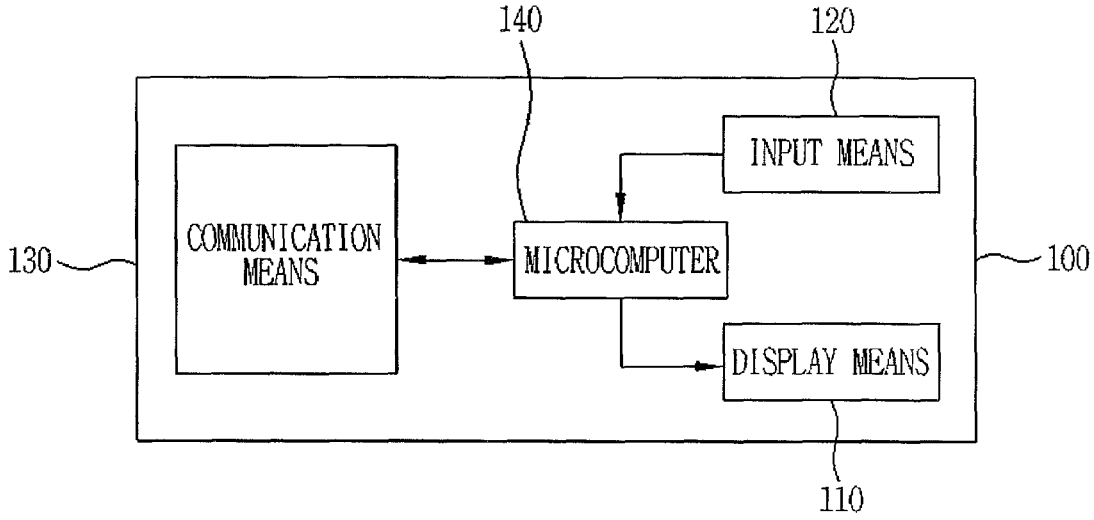
FIG. 9 is a configuration view illustrating a remote controlling device of FIG. 1.

FIG. 9 is a configuration view illustrating the remote controlling device of FIG. 1. As illustrated in FIG. 9, the remote controlling device 100 includes the display means 110 for displaying the state of the air passage of the dryer 1, the input means 120 for acquiring the control command from the user, the communication means 130 for performing communication with the dryer 1, and a microcomputer 140 for providing the state of the air passage to the user by controlling the above elements.

The display means 110 displays not only the clogging state, the clogging degree or the presumed energy consumption amount contained in the state of the air passage but also the processing degree and the remaining time of the drying operation of the dryer 1. For example, an LED display or an LCD display can be used as the display means 110. The display means 110 performs visible and audible display, and thus includes a speaker.

The input means 120 performs input of the control command for the drying operation of the dryer 1, especially, acquires the user input for requesting the information on the state of the air passage to the dryer 1, and applies the user input to the microcomputer 140.

The communication means 130 performs communication with the dryer 1 through the communication network 200. That is, the communication means 130 receives the request for the state of the air passage (the clogging state, the clogging degree, the clogging progressive degree, the presumed energy consumption amount, etc.) from the microcomputer 140, and applies the request to the dryer 1. In addition, the communication means 130 receives the information such as the state of the air passage and the processing degree of the drying operation from the dryer 1, and applies the received information to the microcomputer 140. The communication means 130 is a kind of power line communication module or radio frequency communication module.

The microcomputer 140 receives the state of the air passage by performing communication with the dryer 1 through the communication means 130, and displays the state of the air passage on the display means 110. Here, the microcomputer 140 can request the information such as the state of the air passage according to the user input from the input means 120, or the dryer 1 can independently transmit the information to the remote controlling device 100 through the communication network 200.

The microcomputer 140 converts the received information such as the state of the air passage into a display signal suitable for the display means 110, so that the display means 110 can display the information. That is, since the information such as the state of the air passage is a specific numerical value or ratio, the microcomputer 140 generates the display signal (for example, an audio signal, an image signal, etc.) for displaying the specific numerical value or ratio, and applies the display signal to the display means 110.

The microcomputer 140 can independently compute the presumed energy consumption amount according to the received clogging degree of the air passage. The microcomputer 90 of the dryer 1 can compute and send the presumed energy consumption amount to the remote controlling device 100, or the microcomputer 140 can compute the presumed energy consumption amount according to the method of the microcomputer 90.

The microcomputer 140 has each critical step information on the clogging degree of the exhaust duct 50 and the clogging degree of the lint filter 41. If the clogging degree of the exhaust duct 50 or the clogging degree of the lint filter 41 exceeds the critical step, the microcomputer 140 generates and applies a display signal to the display means 110 to perform the corresponding alarm and display. For example, the off duty ratio of 0.5 can be set as the critical step of the lint filter 41, and the off duty ratio of 0.8 can be set as the critical step of the exhaust duct 50.

Figure 10:
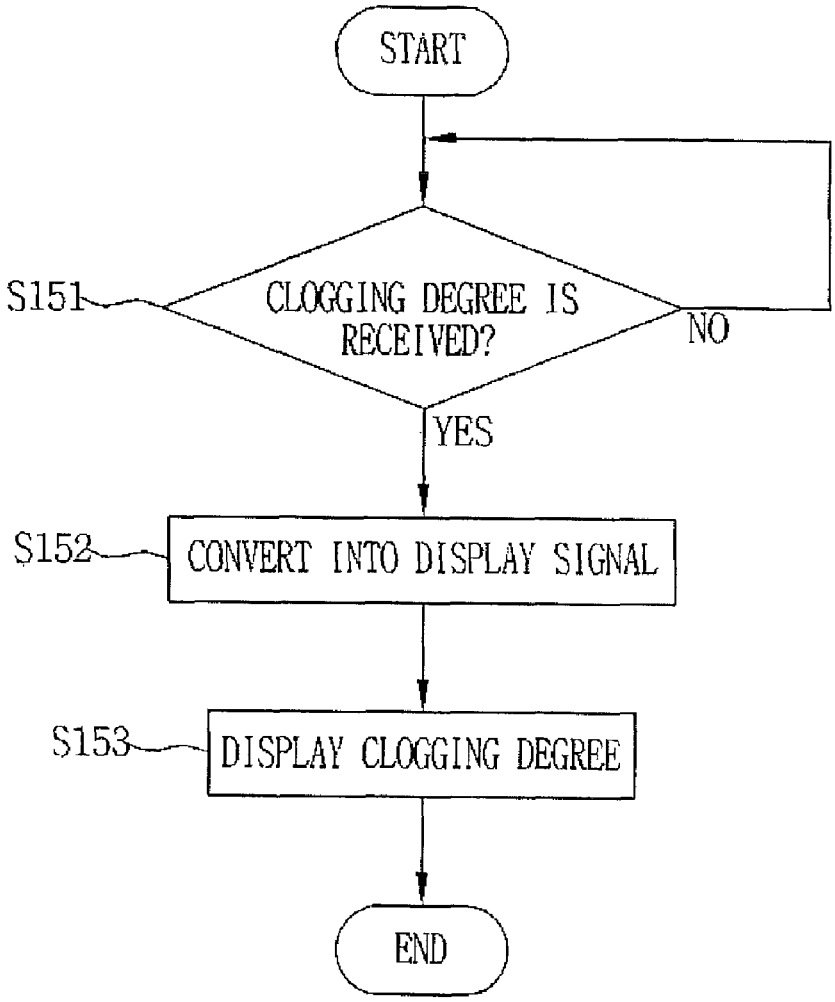
FIG. 10 is a flowchart showing a first operation of the clogging detecting system of FIG. 1.

FIG. 10 is a flowchart showing a first operation of the clogging detecting system of FIG. 1. In the first operation example of FIG. 10, the microcomputer 90 of the dryer 1 independently sends the state of the air passage such as the clogging degree to the remote controlling device 100 through the communication network 200.

In detail, in step S151, the microcomputer 140 decides whether the clogging degree of the air passage has been received from the dryer 1 through the communication means 130. If the clogging degree has been received, the microcomputer 140 goes to step S152, and if not, the microcomputer 140 maintains a standby state.

In step S152, the microcomputer 140 converts the received information such as the clogging degree and clogged part of the air passage into a display signal displayable by the display means 110, and applies the display signal to the display means 110.

In step S153, the display means 110 receives the display signal from the microcomputer 140, and displays the clogging state or degree of the air passage and the presumed energy consumption amount according to the display signal.

Figure 11:
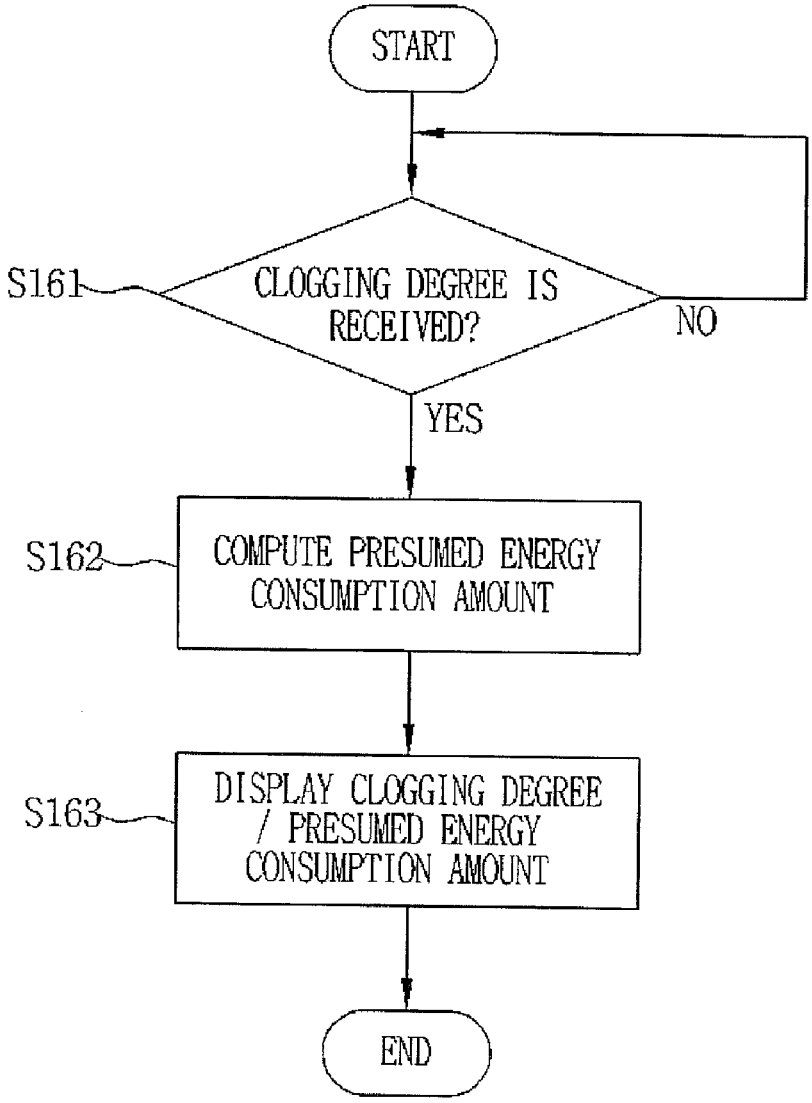
FIG. 11 is a flowchart showing a second operation of the clogging detecting system of FIG. 1.

FIG. 11 is a flowchart showing a second operation of the clogging detecting system of FIG. 1. In the second operation example of FIG. 11, the microcomputer 90 of the dryer 1 independently sends the state of the air passage such as the clogging degree to the remote controlling device 100 through the communication network 200.

In detail, step S161 is identical to step S151 of FIG. 10.

In step S162, the microcomputer 140 computes the presumed energy consumption amount according to the received clogging degree or state. The presumed energy consumption amount can be computed as a specific numerical value or a ratio to the clogging degree. The microcomputer 140 converts the presumed energy consumption amount and the clogging degree into a display signal for display, and applies the display signal to the display means 110.

In step S163, the display means 110 displays the presumed energy consumption amount and the clogging degree to the user.

Figure 12:
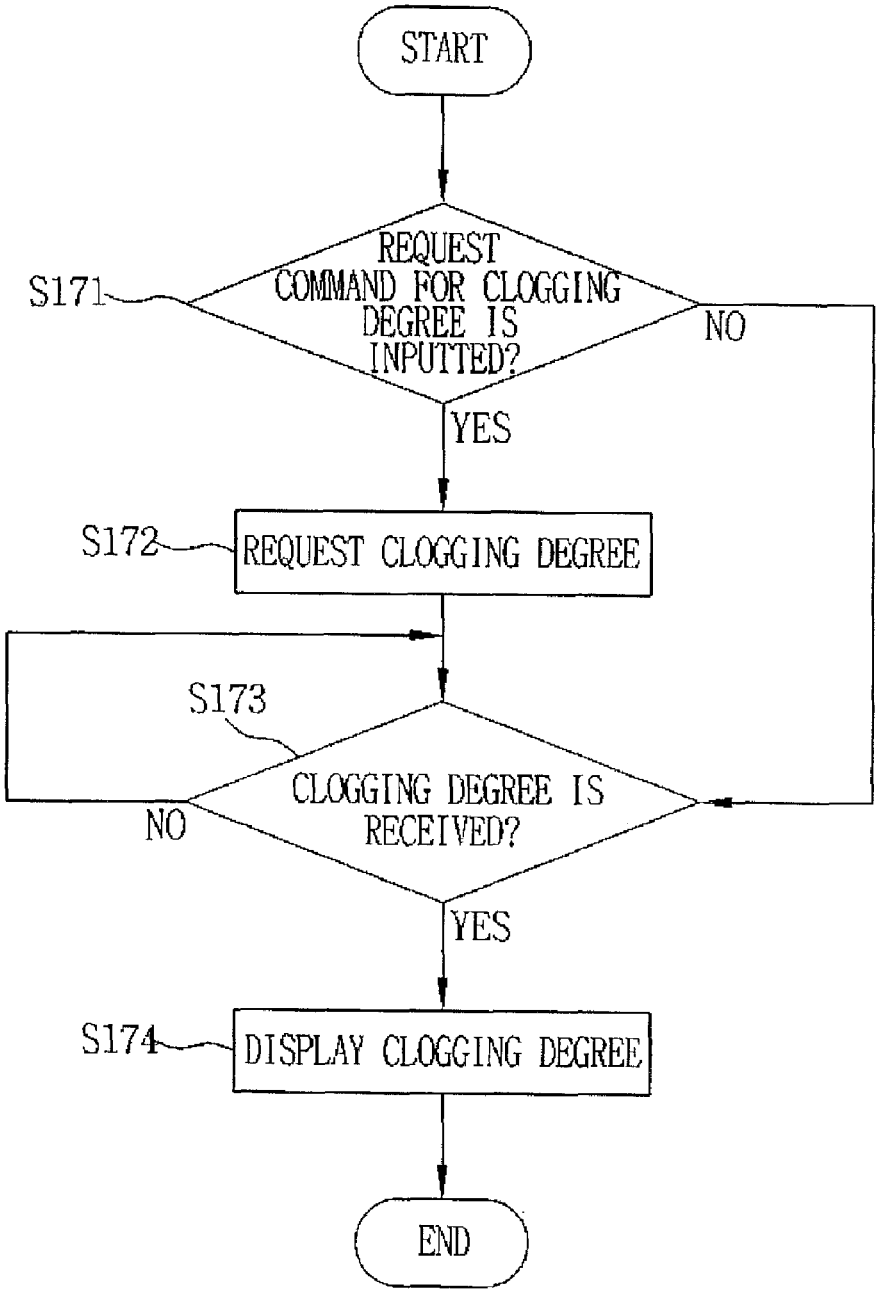
FIG. 12 is a flowchart showing a third operation of the clogging detecting system of FIG. 1.

FIG. 12 is a flowchart showing a third operation of the clogging detecting system of FIG. 1.

In detail, in step S171, the microcomputer 140 decides whether the request command for the clogging state of the air passage has been inputted by the user through the input means 120. If the request command has been inputted through the input means 120, the microcomputer 140 goes to step S172, and if not, the microcomputer 140 goes to step S173.

In step S172, the microcomputer 140 transmits the request command for the clogging degree to the dryer 1 through the communication means 130 according to the request command from the user. The microcomputer 90 of the dryer 1 receives the request command, performs clogging detection in the driving order of FIGS. 7 and 8, and sends the information including the clogging degree to the remote controlling device 100 through the communication means 84.

In step S173, the microcomputer 140 checks whether the clogging degree has been received from the dryer 1. In the above steps S171 and S172, the dryer 1 can check the clogging degree of the air passage by the request of the user or independently. Thus, the microcomputer 140 waits for reception of the clogging degree.

In step S174, the microcomputer 140 converts the received information such as the clogging degree of the air passage into a display signal, and applies the display signal to the display means 110. The display means 110 displays the clogging degree of the air passage according to the display signal.

Figure 13:
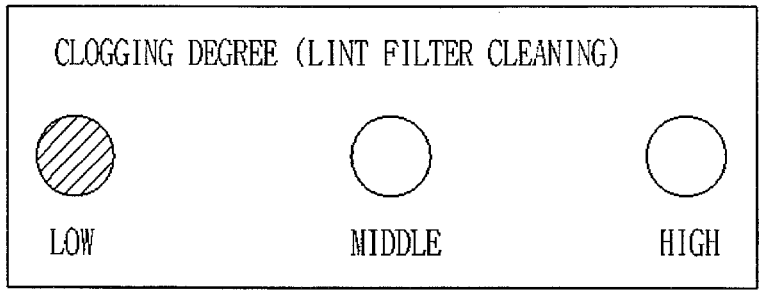
FIGS. 13 to 15 are exemplary views illustrating display examples of the remote controlling device of FIG. 1.
Figure 14:
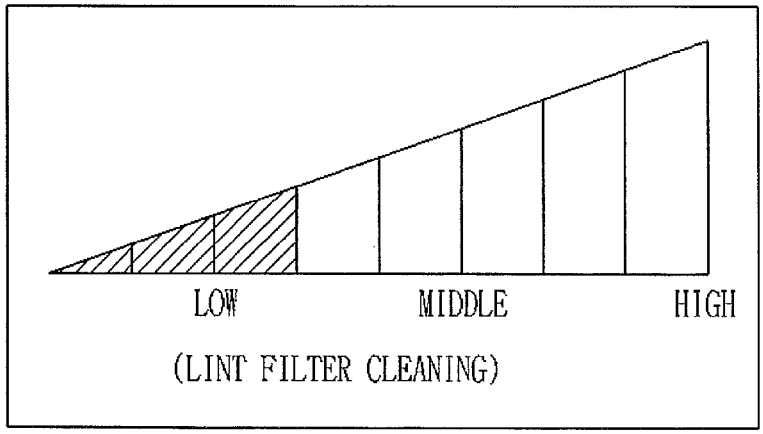
Figure 15:
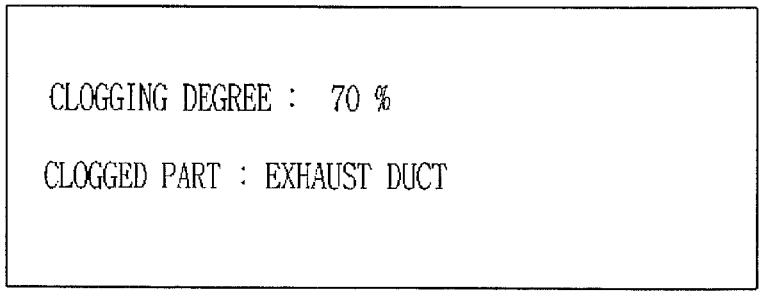

FIGS. 13 to 15 are exemplary views illustrating display examples of the remote controlling device of FIG. 1.

As shown in FIG. 13, the microcomputer 140 displays the clogging degree compared with Table 1 and judged by the microcomputer 90 on the display means 110. Here, the clogging degree (the clogging state of the lint filter 41) and the clogged part can be displayed by using figures and characters.

As depicted in FIG. 14, the display means 110 displays the clogging degree by a bar chart and characters, and also displays the clogged part by characters.

As illustrated in FIG. 15, the display means 110 displays the clogging degree (the off duty ratio) by a percentage (%) and the clogged part by characters. Here, the clogging degree can be represented as the percentage by multiplying the off duty ratio by 100. If the off duty ratio of the air passage is 0.7, it is represented as 70% clogging, which corresponds to clogging of the exhaust duct 50.

In addition, the display means 110 can inform the user of the clogging degree and the clogged part through sound or alarm.

FIGS. 16 to 20 are exemplary views illustrating another display examples of the remote controlling device of FIG. 1.

Figure 16:
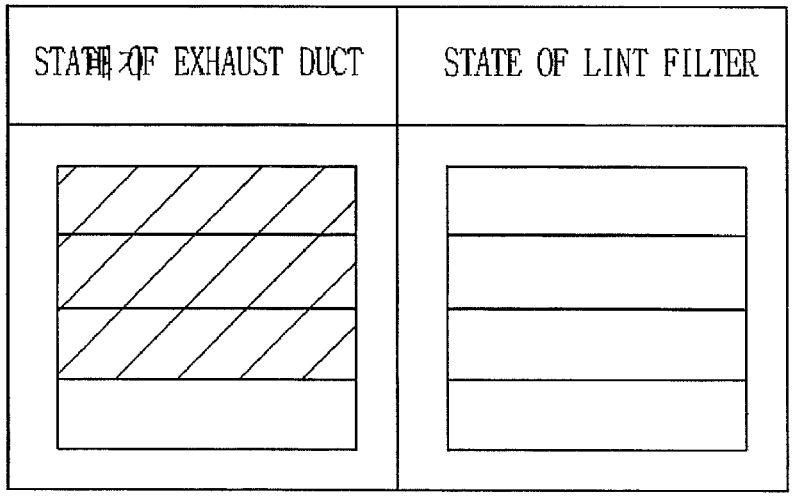
FIGS. 16 to 20 are exemplary views illustrating another display examples of the remote controlling device of FIG. 1.

Referring to FIG. 16, the microcomputer 140 displays the clogging degree of the exhaust duct 50 which is the initial clogging degree set in step S73 by the microcomputer 90, and simultaneously or alternately displays the clogging state or degree of the lint filter 41. FIG. 16 shows a state where the dryer 1 is firstly connected to the exhaust duct 50 and processed by the clogging detecting method. The lint filter 41 is not at all clogged.

Figure 17:
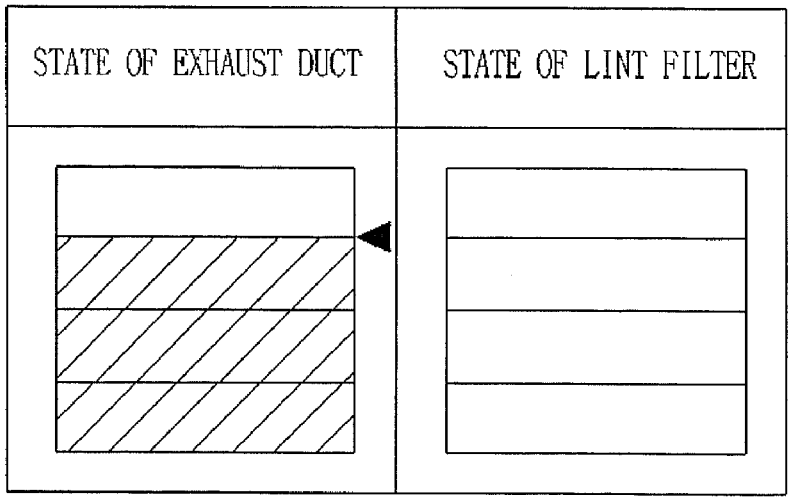

FIG. 17 shows a state where the clogging degree of the exhaust duct 50 rapidly increases from the clogging degree of FIG. 16 due to the drying operation, house moving or clogging of the exhaust duct 50 in step S76 performed by the microcomputer 90. In FIG. 17, if the state of the exhaust duct 50 reaches '◀', the microcomputer 140 decides that the current clogging degree of the exhaust duct 50 reaches the critical step, and visibly or audibly displays a warning message (or cleaning message) for clogging of the exhaust duct 50 through the display means 110. For example, the displayed state of the exhaust duct 50 is flickered to attract the user's attention.

Figure 18:
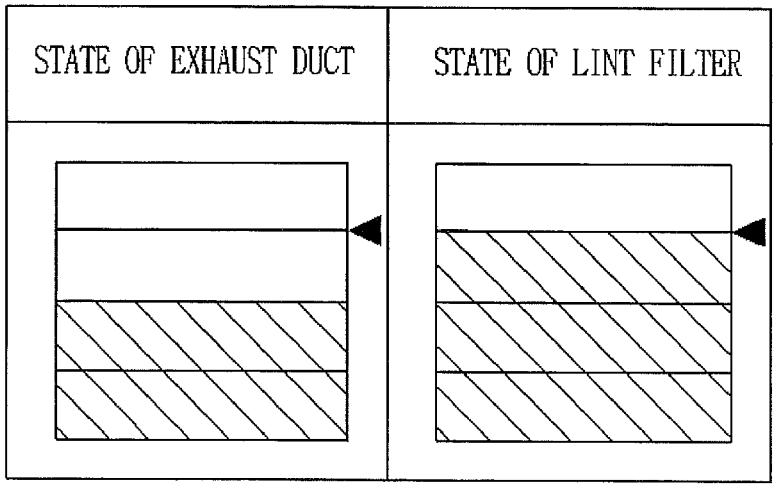

FIG. 18 shows a state where the clogging degree of the lint filter 41 slowly increases from the clogging degree of FIG. 16 due to the drying operation. If the clogging state of the lint filter 41 reaches '◀', the microcomputer 140 decides that the current clogging degree of the lint filter 41 reaches the critical step, and visibly or audibly displays a warning message (or cleaning message) for clogging of the lint filter 41 through the display means 110. For example, the displayed state of the lint filter 41 is flickered to attract the user's attention.

Figure 19:
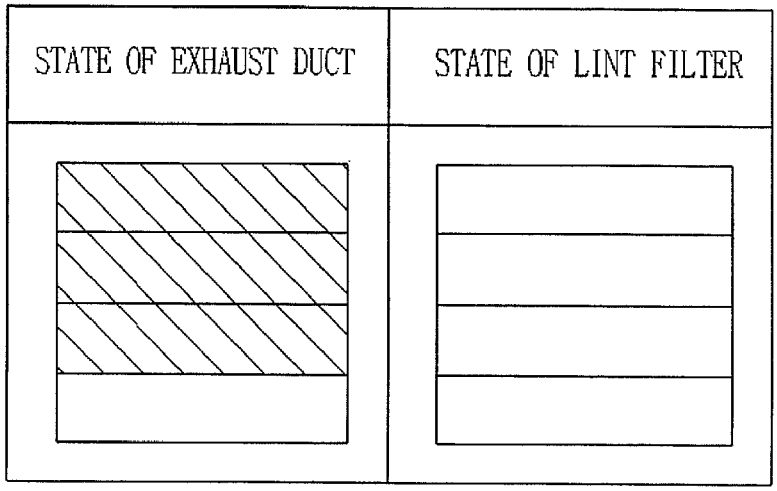

FIG. 19 shows a state change of the exhaust duct 50 by cleaning or house moving, and a state change of the lint filter 41 by cleaning in FIG. 18.

Figure 20:
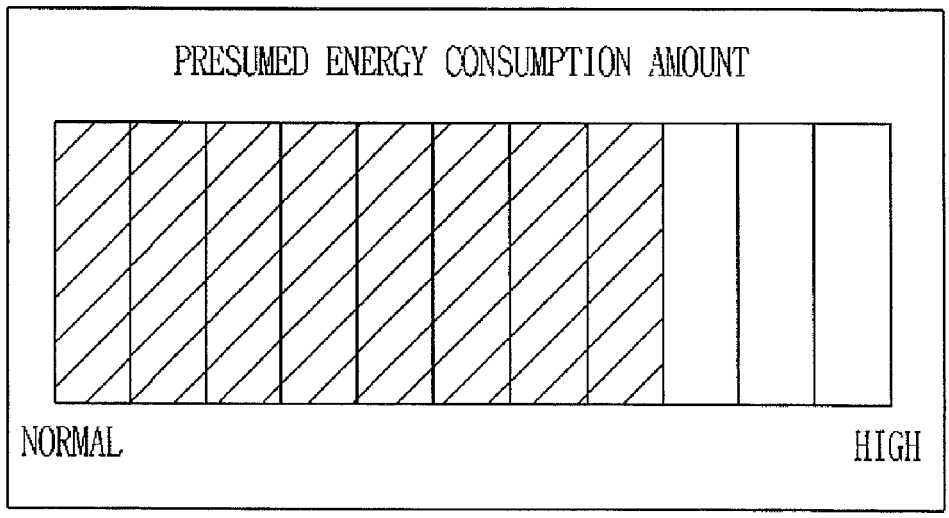

FIG. 20 shows the presumed energy consumption amount computed by the microcomputer 90 or 140. If the air passage is not clogged up, the 'normal' range is displayed, and if the air passage is seriously clogged up or gets clogged up fast, the 'high' range, which is a wide range, is displayed. If the drying operation is not smoothly performed due to clogging of the air passage, the drying time increases and thus power consumption increases. The user can recognize such a state.

As discussed earlier, in accordance with the present invention, the clogging detecting system for the dryer can precisely judge the clogging degree of the air passage and provide the judgment result to the short or long distance user.

The clogging detecting system for the dryer can check the clogging degree and the clogged part of the air passage, and provide the checked result through the remote controlling device by the request of the user or in the real time.

The remote controlling device and the interface device thereof can provide the useful information to the user by requesting confirmation of the clogging information of the air passage and displaying the checked clogging information.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A clogging detecting system for a dryer, comprising:

a processor to judge a state of an air passage of the dryer and to send a signal indicative of the state to a remote controlling device; and a remote controlling device to receive the signal indicative of the state and to display an indication of the state through a display unit, wherein:

the remote controlling device sends a request command for the state of the air passage to the dryer, the processor judges and sends information indicative of the state to the remote controlling device, and the remote controlling device displays an indication of the state wherein the state is one of a clogging degree and a non-clogging state and wherein display unit displays the indication of the clogging degree by at least two steps or the indication of the non-clogging state.

2. The clogging detecting system of claim 1, wherein the remote controlling device comprises an input unit for acquiring the request command for the state of the air passage from a user.

3. The clogging detecting system of claim 1, wherein the dryer comprises an input unit for acquiring a request command for the state of the air passage from the user.

4. The clogging detecting system of claim 1, wherein the dryer and the remote controlling device perform power line communication or radio frequency communication.

5. The clogging detecting system of claim 1, wherein the display unit visibly or audibly displays the indication of the state.

6. The clogging detecting system of claim 1, wherein the display unit displays the clogging degree of a lint filter or the clogging degree of an exhaust duct by the at least two steps.

7. The clogging detecting system of claim 6, wherein, when the clogging degree is judged to be over a critical step, the display unit displays a warning message.

8. An interface device for a remote controlling device, comprising:

a communication circuit to receive a signal indicative of an air passage of a dryer;

a display to display an indication of the clogging degree;

a controller to apply a display signal corresponding to the received clogging degree to the display; and a user input device to request the clogging degree of the air passage to the dryer, wherein the state includes a clogging degree and a non-clogging state and wherein the display displays the clogging degree by at least two steps and the non-clogging state.

9. The interface device of claim 8, wherein the display displays the indication of the state of a lint filter or the clogging degree of an exhaust duct by the at least two steps.

10. The interface device of claim 9, wherein, when the clogging degree of at least one of the lint filter or the clogging degree of the exhaust duct is over a critical step, the display displays a warning message.

11. The interface device of claim 8, wherein the display displays a presumed energy consumption amount corresponding to the clogging degree.

12. A remote controlling device, comprising:

a communication circuit to communicate with a dryer;

a controller to control the communication circuit to receive a signal indicative of a clogging degree of an air passage from the dryer;

a display, interworking with the controller, to display an indication of the clogging degree; and an input device to acquire a request command for the clogging degree of the air passage from a user, wherein the state is one of a clogging degree and a non-clogging state and wherein display unit displays the indication of the clogging degree by at least two steps or the indication of the non-clogging state.

13. The remote controlling device of claim 12, wherein the controller converts the signal indicative of the state into a display signal, and applies the display signal to the display.

14. The remote controlling device of claim 12, wherein the controller computes a presumed energy consumption amount corresponding to the clogging degree of at least one of the lint filter or clogging degree of the exhaust duct, and displays the presumed energy consumption amount on the display.

15. The clogging detecting system of claim 1, wherein the processor judges the state of a lint filter or the state of an exhaust duct based on a duty cycle of a control signal used to control power to a heater of the dryer.

16. The clogging detecting system of claim 15, wherein the processor judges that the lint filter is clogged and the exhaust duct is not clogged when an off duty ratio of the control signal used to control power to the heater is above a first value and lower than a second value, and wherein the second value is greater than the first value.

17. The clogging detecting system of claim 16, wherein the processor judges that the exhaust duct is clogged when the off duty ratio of the control signal is above the second value.

* * * * *